US007918362B2

(12) United States Patent
Schmitt

(10) Patent No.: US 7,918,362 B2
(45) Date of Patent: Apr. 5, 2011

(54) TRANSPARENT, PORTABLE SECURE CONTAINER FOR CONSUMER PRODUCTS NOT LEGALLY PURCHASED BY MINORS

(75) Inventor: Robert J. Schmitt, Excelsior, MN (US)

(73) Assignee: Just Encase Products, Inc., Excelsior, MN (US)

( * ) Notice: Subject to any disclaimer, the term of this patent is extended or adjusted under 35 U.S.C. 154(b) by 468 days.

(21) Appl. No.: 11/973,453

(22) Filed: Oct. 9, 2007

(65) Prior Publication Data

US 2009/0090730 A1 Apr. 9, 2009

(51) Int. Cl.
*B65D 25/54* (2006.01)
*B65D 45/16* (2006.01)

(52) U.S. Cl. ..... 220/665; 220/324

(58) Field of Classification Search ..... 206/139; 220/23.87, 23.86, 23.83, 592.03, 592.02, 220/592.26, 592.2, 62.22, 62.12, 62.11, 660, 220/592.01
See application file for complete search history.

(56) References Cited

U.S. PATENT DOCUMENTS

| | | | | | |
|---|---|---|---|---|---|
| 209,556 | A | * | 11/1878 | Gilbert | 220/810 |
| 1,113,608 | A | * | 10/1914 | Franks | 220/6 |
| 1,877,039 | A | * | 9/1932 | Partiot | 220/836 |
| 2,125,856 | A | * | 8/1938 | De Witt | 220/532 |
| 2,302,661 | A | * | 11/1942 | Benson | 16/267 |
| 2,385,866 | A | * | 10/1945 | Kuehner | 62/372 |
| 2,648,954 | A | * | 8/1953 | Wheeler et al. | 62/371 |
| 2,759,782 | A | | 8/1956 | Goodwin, Jr. | |
| 3,524,564 | A | * | 8/1970 | Schurman | 220/324 |
| 3,612,335 | A | * | 10/1971 | Schurman | 220/324 |
| 3,734,336 | A | * | 5/1973 | Rankow et al. | 220/516 |
| 3,974,658 | A | * | 8/1976 | Starrett | 62/60 |
| 3,988,909 | A | | 11/1976 | Catapano | |
| 4,093,101 | A | * | 6/1978 | Braun | 220/516 |
| 4,125,305 | A | | 11/1978 | Kasindorf | |
| 4,854,448 | A | | 8/1989 | Hair, II | |
| 4,951,832 | A | * | 8/1990 | Tenney et al. | 220/23.83 |
| 4,989,744 | A | * | 2/1991 | Tominaga | 220/835 |
| 5,064,088 | A | * | 11/1991 | Steffes | 220/837 |
| 5,259,215 | A | * | 11/1993 | Rocca | 62/371 |
| 5,318,810 | A | * | 6/1994 | Nissel | 428/35.7 |
| 5,322,178 | A | * | 6/1994 | Foos | 220/326 |
| 5,535,883 | A | * | 7/1996 | Henderson | 206/427 |
| 5,755,350 | A | * | 5/1998 | Marthaler | 220/324 |
| 6,167,680 | B1 | * | 1/2001 | Horn | 53/473 |
| 6,607,100 | B2 | | 8/2003 | Phelps et al. | |
| 7,252,204 | B1 | | 8/2007 | Small | |
| 2003/0051645 | A1 | | 3/2003 | Rigatuso, Jr. | |
| 2005/0145635 | A1 | * | 7/2005 | Slovak et al. | 220/602 |
| 2005/0218145 | A1 | * | 10/2005 | Holley | 220/592.01 |

* cited by examiner

*Primary Examiner* — Anthony Stashick
*Assistant Examiner* — Robert J Hicks
(74) *Attorney, Agent, or Firm* — Kinney & Lange, P.A.

(57) ABSTRACT

A transparent, portable secure container is configured to accommodate a standard retail package for a consumer product not legally purchased by minors. The container comprises a plurality of panels, a hinge and a lock. Some of the panels are joined to form the container, such that the container conforms to outside dimensions of the standard retail package. One of the panels is coupled to the container via the hinge to form a door. The lock secures the container by locking the door in a closed position. The panels are formed of a lightweight, durable structural material, such that the container is portable. At least one of the panels is transparent, such that the container provides an interior view when the door is in the closed position.

18 Claims, 5 Drawing Sheets

TRANSPARENT, PORTABLE SECURE CONTAINER FOR CONSUMER PRODUCTS NOT LEGALLY PURCHASED BY MINORS

BACKGROUND

This invention relates generally to secure containers for household use, and in particular to portable secure containers for alcoholic beverages, medicines, and related products. Specifically, the invention concerns a transparent, secure container configured to accommodate a variety of standard multiple-unit retail packages, including standard retail beverage packages for beer, wine and liquor, or other consumer products not legally purchased by minors.

Liquor stores, supermarkets, and other beverage retailers commonly merchandise alcoholic beverages to consumers in disposable cardboard containers, cans, and glass or plastic bottles. These containers fall into a number of standard configurations, depending upon the size of the individual beverage units (such as bottles or cans), and the number of units in each package (whether one individual package, or a multiple-unit package for holding six, nine, twelve, twenty-four, thirty, or another number of individual units).

These standard retail packages perform a number of functions, including storage, portability, display and marketing. Once a package has left its point of sale, however, and particularly after it has been opened, the package does not provide substantial security against unauthorized access. To the contrary, standard six-packs, returnable cases, and low-profile "fridge packs" are designed primarily for visibility and accessibility, not security. There is thus a need for a secure container that restricts access to certain consumer products by underage, incompetent, or otherwise unauthorized persons, while retaining the storage, portability, display and marketing functions of the products' standard retail packaging.

SUMMARY

This invention concerns a transparent, portable secure container configurable to accommodate a variety of standard retail packages for consumer products not legally purchased by minors, including standard retail packages for beer and other alcoholic beverages. The secure container comprises a plurality of panels, a hinge and a lock. The panels are comprised of a lightweight, durable material such as durable plastic polymer. At least one of the panels is formed of a lightweight, durable material that is also transparent.

Some of the panels are joined to form sides and ends of the container, such that the panels conform to the outside dimensions of the standard retail package, including a spacing tolerance. At least one panel is coupled to the container via the hinge to form a door. The door has an open position, in which the container provides access to the standard retail package, and a closed position, in which the container restricts access. The lock secures the door in the closed position. The transparent panel provides an interior view of the standard retail container when the door is in the closed position.

DETAILED DESCRIPTION

Figure 1:
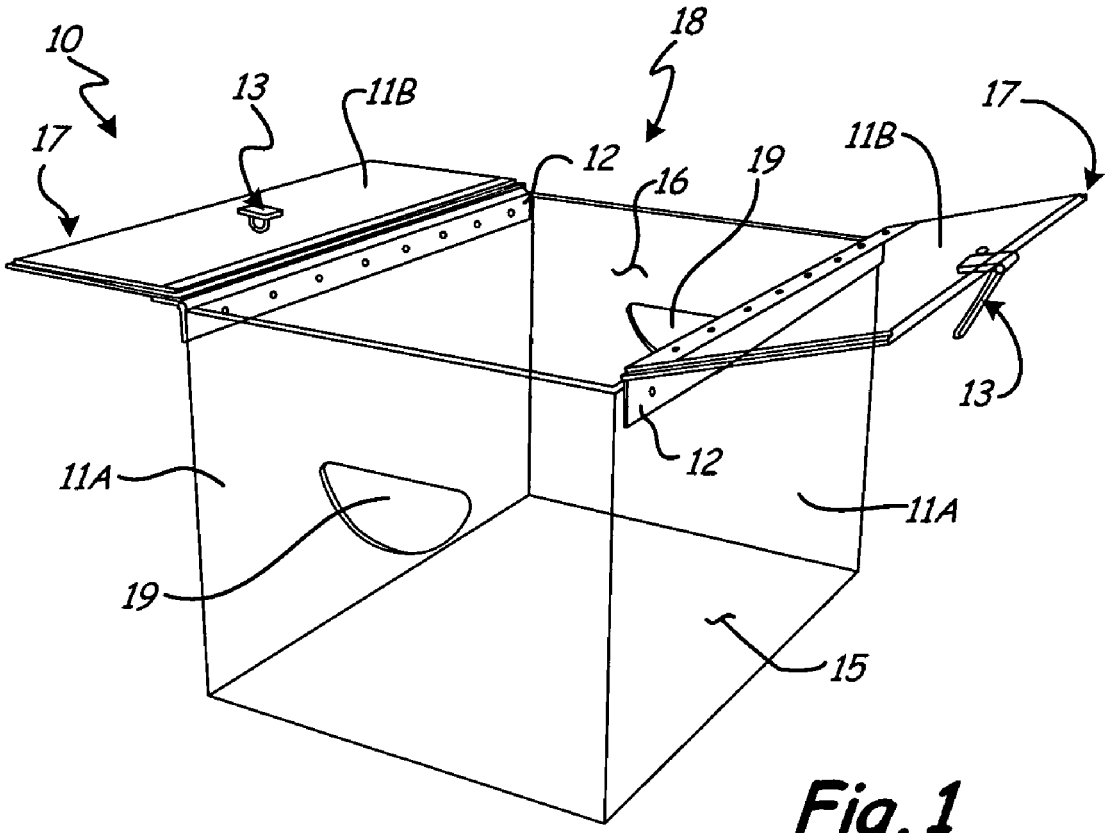
FIG. 1 is a perspective view of a transparent, portable secure container, in an embodiment configured to accommodate a standard twenty-four bottle retail package.

FIG. 1 is a perspective view of transparent, portable secure container 10, in an embodiment configured to accommodate a standard twenty-four bottle retail package. Secure container 10 comprises plurality of wall panels 11A, at least one door panel 11B, at least one hinge 12, and at least one lock 13.

Panels 11A and 11B are comprised of light, durable structural materials, including, but not limited to, durable polymers such as thermoplastics and lightweight durable cellulose-based materials such as wood. At least one of panels 11A and 11B is further comprised of a transparent, durable structural material such as a transparent thermoplastic.

Thermoplastics are strong, light, durable, relatively inexpensive, and easy to machine. Transparent thermoplastics include acrylic (polymethyl methacrylate, or PMMA; also known as acrylic glass) and polycarbonate materials. Acrylic is a transparent thermoplastic, available under trade names including Plexiglas®, from Arkema Corporation of Philadephia, Pa.; and Lucite® or Perspex®, from Lucite International of Cordova, Tenn. Polycarbonates are bisphenol A-based polycarbonate resin thermoplastics, available under trade names including Lexan®, from GE Plastics of Pittsfield, Mass.; Calibre®, from Dow Chemical of Midland, Mich.; and Panlite®, from Teijin Chemicals of Tokyo, Japan.

Polycarbonates are typically somewhat more expensive than acrylics, but they are also stronger (polycarbonates are used in aircraft canopies and "bulletproof" glass), and highly transparent to visible light. In the particular embodiment of FIG. 1, each of wall panels 11A and door panels 11B is comprised of a transparent polycarbonate thermoplastic. In preferred embodiments, the polycarbonate has a scratch-resistant coating, as available with polycarbonates sold under trade names including Lexan® Margard®, from GE Plastics, or as a separate protective layer such as SCLARL 150, from 3M Corporation of Saint Paul, Minn.

Plurality of wall panels 11A are permanently joined together to form at least two of a top, a bottom, sides, and ends of container 10. In the particular embodiment of FIG. 1, for example, five wall panels 11A are joined to form one bottom 14, two sides 15 and two ends 16 of container 10.

At least one door panel 11B is coupled to container 10 via at least one hinge 12 to form at least one door 17. In this example, two door panels 11B are coupled to container 10 via two hinges 12 to form two top doors 17 on top 18 of container 10. In other embodiments, door panel or panels 11B form one or more side doors, end doors, or bottom doors. These alternate embodiments include, but are not limited to, the particular configurations of FIGS. 2, 3A-3C, 4A-4B, and 5A-5B, below.

Hinges 12 allow door panels 11B to pivot or rotate between a closed position and an open position, and back again, without detaching from container 10. In general, container 10 provides access to the interior (that is, to the standard retail package) with door or doors 17 in the open position, and container 10 restricts access with door or doors 17 in the closed position.

As shown in FIG. 1, hinges 12 are continuous living hinges formed of a resilient, flexible and fatigue-resistant polymer such as polypropylene, extending along substantially the entire length of door panels 11B. In other embodiments, hinges 12 are non-continuous hinges extending along a part or parts of door panels 11B. In further embodiments, hinges 12 are non-living hinges comprising hinge plates and a hinge pin. Alternatively, hinges 12 are sliding hinges (also known as drawer slides). Sliding hinges allow door panels 11B to slide between the closed position and the open position (and back again), rather than pivoting or rotating as in a standard hinge configuration.

Lock (locking mechanism) 13 secures door or doors 17 (equivalently, door panels or door panels 11B) in the closed position. In this particular embodiment, lock 13 comprises a two-piece hasp mechanism configured to receive a padlock or similar locking mechanism (not shown). In general, lock 13 encompasses a range of forms, as discussed below with respect to FIG. 2.

In some embodiments, at least one handle 19 is provided in at least one of panels 11A, 11B. In the particular example of FIG. 1, for example, two handles 19 are provided in wall panels 11A on ends 16 of container 10. In preferred embodiments, handle or handles 19 are provided proximate analogous structures on the standard retail package, but the specific configuration and positioning of handles 19 varies from embodiment to embodiment.

Handles 19 illustrate the portability of container 10, which is lightweight and configured for easy hand carrying from one location to another, including wholesale and retail locations, and consumer locations including a refrigerator, a freezer, a garage, a yard, a boat, or the storage area of a motor vehicle. This distinguishes from prior art secure containers that are heavy and stationary, rather than lightweight and portable, or are configured for mounting to a fixed object or structure. While handles 19 facilitate the portability of container 10, moreover, portability is incorporated into the design, such that container 10 is portable with or without handles 19.

In the particular embodiment illustrated by FIG. 1, the outside dimensions of container 10 are approximately seventeen and one quarter inches (17¼") long, twelve inches (12") wide and ten and three quarters inches (10¾") high (approximately 43.8 cm×30.5 cm×27.3 cm). With these dimensions, container 10 is referred to as a twenty-four bottle secure case, and is configured to hold a standard twenty-four bottle retail beverage container, such a standard beer case with a capacity of twenty-four bottles, each holding sixteen-ounces of beer.

TABLE 1

Transparent, Portable Secure Container Configurations

| | | Outside Dimensions (L × W × H) | |
|---|---|---|---|
| FIGS. | Configuration | Customary (in) | Metric (cm) |
| 1 | 24 Bottle Case | 17¼ × 12 × 10¾ | 43.8 × 30.5 × 27.3 |
| 2 | 9 Bottle Wine Case | 12⅛ × 12 × 12 | 30.8 × 30.5 × 30.5 |
| 3A-3C | 24 Can Case | 17¼ × 12 × 6¼ | 43.8 × 30.5 × 15.9 |
| 4A-4B | 12 Can Fridge Pack Case | 17¼ × 6¼ × 6½ | 43.8 × 15.9 × 16.5 |
| 5A-5B | Med Case | 10¼ × 10 × 8¾ | 26.0 × 25.4 × 22.2 |
| [N/A] | 12 Can Case | 12¼ × 9½ × 5⅞ | 31.1 × 24.1 × 14.9 |
| [N/A] | 30 Can Case | 14½ × 9¼ × 11 | 36.8 × 23.5 × 27.9 |
| [N/A] | Liquor Case | 10¾ × 17½ × 14½ | 27.3 × 44.5 × 36.8 |
| [N/A] | 3 Carton Cigarette Case | 13¼ × 7¼ × 5½ | 33.7 × 18.4 × 14.0 |

In preferred embodiments, container 10 takes on a number of different forms, including, but not limited to, the various configurations listed in Table 1. In these preferred embodiments, each outside dimension of container 10 is greater than five inches (5", or 12.7 cm), and at least one outside dimension of container 10 is greater than ten inches (10", or 25.4 cm). These dimensions allow container 10 to accommodate standard retail packages for consumer products like alcohol and tobacco, which cannot legally be purchased by minors and other persons not having attained the legal age for alcohol or tobacco purchases. These embodiments also facilitate portability and placement inside cooling equipment such as refrigerators, because the embodiments have no outside dimension exceeding twenty inches (20", or 50.8 cm).

Figure 2:
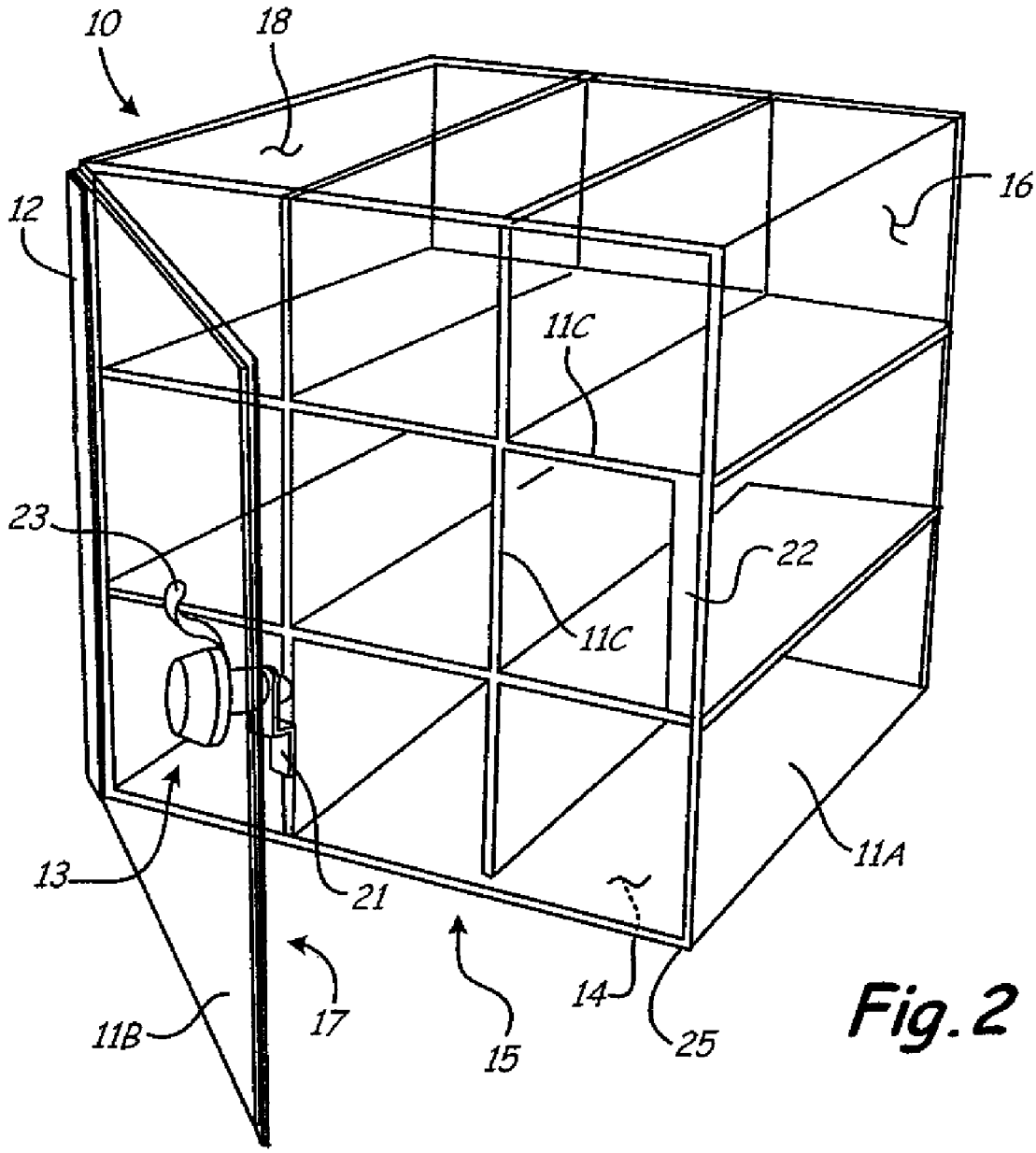
FIG. 2 is a perspective view of a transparent, portable secure container, in an embodiment configured to accommodate standard multiple-serving beverage bottles.

FIG. 2 is a perspective view of transparent, portable secure container 10 in an embodiment configured to accommodate standard multiple-serving beverage bottles. In this embodiment, single door panel 11B and hinge 12 form single side door 17 on side 15 of container 10.

In the embodiment of FIG. 2, the outside dimensions of container 10 are twelve and one eighth inches (12⅛") by twelve inches (12"), by twelve inches (12") high (approximately 30.8 cm×30.5 cm×30.5 cm). With these dimensions, container 10 is referred to as a wine case, and is configured to hold a number of standard wine or liquor bottles. The bottles each have capacity, for example, of seven hundred and fifty milliliters (750 ml) or more. As with other embodiments of secure container 10, these dimensions vary with capacity of the standard retail package, and with the number of units container 10 is configured to hold.

In some embodiments, the wine case configuration utilizes internal partition panels 11C, as shown in FIG. 2. Partition panels 11C are formed of similar materials, in similar thicknesses, as side panels 11A and door panel or panels 11B (described above). Partition panels 11C form shelves or dividers to divide container 10 into a number of individual storage areas, for storing a number of standard retail packages.

In embodiments comprising partition panels 11C, secure container 10 accommodates standard retail packages by conforming each individual storage area to the outside dimensions of the standard retail package, including a spacing tolerance. In these embodiments the spacing tolerance typically varies somewhat from non-partitioned configurations, in order to provide access to each individual storage area and to accommodate a range of standard retail package dimensions. The spacing tolerance, however, typically remains on the order of the width of the panels; that is, it does not typically exceed ten times the panel width, or fall below a fraction of the panel width.

In general, container 10 has both horizontal and vertical orientations, depending upon the particular application. Still wines, for example, are usually stored horizontally, while beer bottles are typically stored vertically; champagne storage, on the other hand, varies according to custom and preference. This illustrates that the various designations for bottom 14, sides 15, ends 16 and top 18 are relative, rather than absolute, and may vary with the orientation of container 10. The same is true for dimensions designated length, width, and height. Specifically, in a vertical orientation, door 17 may equivalently be described as a top door, rather than a side door or end door, as shown in the horizontal orientation of FIG. 2. The number of partition panels 11C and individual storage areas is also merely illustrative, and varies along with the dimensions of the standard retail package, and the number held.

FIG. 2 shows lock 13 in more detail. In this particular embodiment, lock 13 comprises a three-dial combination cam lock, which secures door 17 in the closed position by rotating cam stop 21 behind door stop 22. Door stop 22 is comprised of the same or similar materials as panels 11A, 11B and 11C. Finger pull 23 is used to open or close door 17 when not secured by lock 13.

In other embodiments, lock 13 comprises a four- or five-dial combination lock, with similar dial action, or a one-dial rotary combination lock, with sequential action. Alternatively, lock 13 comprises a padlock, a mechanical pushbutton combination lock, or a similar mechanical locking mechanism. In further embodiments, lock 13 is any of a variety of electronic locks, including digital electronic locks and fingerprint-sensitive electronic locks. In these embodiments, cam stop 21 and door stop 22 take on a range of alternate forms corresponding to the particular mechanical features of lock 13.

Container 10 and lock 13 are designed to strike a balance between security (restricted access to unauthorized persons) and reasonability of deterrence. In typical embodiments, lock 13 presents a significant physical barrier to young persons and mentally incompetent persons, for whom access to container 10 may pose a significant risk. Lock 13 is typically distinguished from more advanced, high-security locking mechanisms, however, such as a typical safe lock. For authorized persons having the proper key or combination, lock 13 is relatively easy to open, without precision mechanical manipulation.

No security system, of course, is foolproof. Regardless of complexity, is it possible that lock 13 may be defeated by non-authorized persons. Container 10 nonetheless provides a reasonable physical barrier to unauthorized access, and further serves as constructive notice that any such access occurs without permission from the owners of container 10 and its contents.

Along with FIG. 1, above, FIG. 2 illustrates a range of exemplary methods of manufacture for container 10. In these methods, wall panels 11A and door panels 11B are each cut from a sheet of panel material. In a preferred method, panels 11A, 11B have a uniform width defined by the thickness of the panel material, where the uniform width is between one eighth of an inch and three eights of an inch (⅛-⅜", or approximately 3 mm-10 mm). In alternate embodiments, panels 11A, 11B have various different widths, either inside or outside of this range.

Panels 11A, 11B are cut along edges to accommodate a standard retail package, with panels for each top, bottom, side and end conforming to the respective maximum outside dimensions of the standard retail container, plus joint and spacing tolerances. Specifically, panels 11A, 11B are cut with an additional joint tolerance to provide for joining wall panels 11A and door panels 11B to form container 10, and with an additional spacing tolerance to provide a space between container 10 and the standard retail package, including some variation in standard package dimensions.

The joint tolerance is typically equal to the width of the panels or less, depending on joining technique. For panels joined by rabbet joints, for example, rabbets are routed or milled along inside edges of some panels, and other panels are joined along the rabbet. In these embodiments, the joint tolerance ranges from the depth of the rabbet to the thickness of the panels. In other embodiments, panels 11A are joined at butt joints, mitered rabbet joints, or other joints, and the joint tolerance varies accordingly.

The spacing tolerance is typically on the order of the panel width; that is, at least as great as the panel width, but less than ten times the panel width. For typical panel widths, the spacing tolerance is at least one quarter inch (¼", or 6.4 mm), and less than one and one half inches (1.5", or 3.8 cm).

A preferred spacing tolerance in length is approximately one and one quarter inches (1¼", or 3.2 cm), which includes a lock and cam stop clearance. A preferred spacing tolerance in width is approximately one inch (1", or 2.5 cm), which includes a lock stop clearance. A preferred spacing tolerance in height is approximately one half inch (½", or 1.3 cm), which includes a grip or finger tolerance. In other embodiments, the definitions of these tolerances vary depending upon the configuration and orientation of container 10. In further embodiments, the dimensions vary with the dimensions of the lock, cam stop, or lock stop, and with the desired finger or grip tolerance.

The joint and spacing tolerances are added to each cut edge of panels 11A, 11B, such that the panels have total dimensions equal to the standard retail package (maximum outside dimensions), plus a total tolerance ranging from approximately the panel width, to approximately several times the panel width. When the panels are assembled, secure container 10 accommodates the standard retail package by conforming to the outside dimensions of the retail package, plus the spacing tolerance.

In preferred manufacturing methods, some cut edges are rounded by milling, routing, cutting, sanding, or other technique to eliminate sharp corners, or for aesthetic purposes. Depending upon configuration and order of construction, rounding is typically performed on some cut edges of panels 11A, 11B before assembly, and on other cut edges after assembly. In these embodiments, cut edges that are exposed after construction of container 10, such as cut edges that form outside corners, are typically rounded. Cut edges that are not exposed after construction of container 10, such as cut edges that form inside corners or are assembled along hinge or hinges 12, are typically not rounded.

Wall panels 11A are assembled by forming joints along the cut edges. In preferred methods, the joints are perpendicular or ninety-degree (90°) joints, formed by gluing or another means of chemical or mechanical fastening. In a preferred method, the joints are formed by providing capillary-acting glue along the joints. In this method, the panels are sometimes held in place with a temporary means such as an assembly jig or temporary adhesive tape. Door stop 22 and any divider/partition panels 11C are also cut to fit, and joined to container 10 via similar methods. Door stop 22, for example, is joined to container 10 proximate door 17 and opposite hinge 12, while partition panels 11C are joined to container 10 as required to form individual storage areas.

In embodiments utilizing continuous living hinge 12, hinge 12 is cut to length along wall panel 11A and door panel or panels 11B. Hinge 12 is then folded longitudinally into two living hinge plates. A row of holes is drilled or otherwise formed in each hinge plate, preferably comprising end holes positioned approximately one-half inch (½", or 13 mm) from each end of hinge 12, and additional holes evenly spaced between the end holes, approximately every two inches (2") or less (approximately 5 cm or less). Corresponding holes are formed in wall panel 11A and door panel or panels 11B, allowing hinge 12 to be secured to container 10 via a mechanical attachment such as rivets (see FIGS. 4A and 4B).

In alternate embodiments, hinge 12 is not a continuous living hinge, but takes another form as described with respect to FIG. 1, above. In these embodiments, the number and spacing of the holes are determined according to the particular structure of hinge 12, and the mechanical fastenings take a number of forms including, but not limited to, screws, bolts, glue and chemical welds.

Cam lock 13 is mounted in door panel 11B through a hole appropriately sized and located to secure cam lock 13, such that cam stop 21 rotates behind door stop 22. This allows cam lock 13 to secure door 17 in a closed position, and allows finger pull 23 to open and close door 17 when unsecured.

In some embodiments, soft plastic feet or similar support elements 25 are attached to the outside (bottom) surface of wall panel 11A at bottom 14 of container 10. Support elements 25 take a number of forms and are available under a number of trade names, including Bumpons®, from 3M Corporation of Saint Paul, Minn.

FIG. 2 illustrates an additional advantage of secure container 10 with respect to the prior art. Because panels 11A, 11B, 11C are manufactured of lightweight materials, the manufacture of container 10 does not require heavy machinery, welding, or other heavy industrial techniques. This contrasts with traditional secure container construction and manufacture techniques in the prior art, which require large machinery and specialized metalworking equipment.

Nonetheless, the particular manufacturing methods disclosed here are merely exemplary. In other methods, the panels are formed by alternate processes such as molding, and features such as handles 19 are formed in a unitary fashion with the panels. In these embodiments, any number of panels are joined by being manufactured as unified structures to form a bottom, top, sides, or ends of container 10, or to form interior shelves or dividers. Alternatively, any number of panels are formed of non-polymer lightweight materials such as wood. For these embodiments, typical manufacturing methods employ alternate cutting, joining and mechanical fastening techniques, as appropriate to the particular materials used.

Figure 3A:
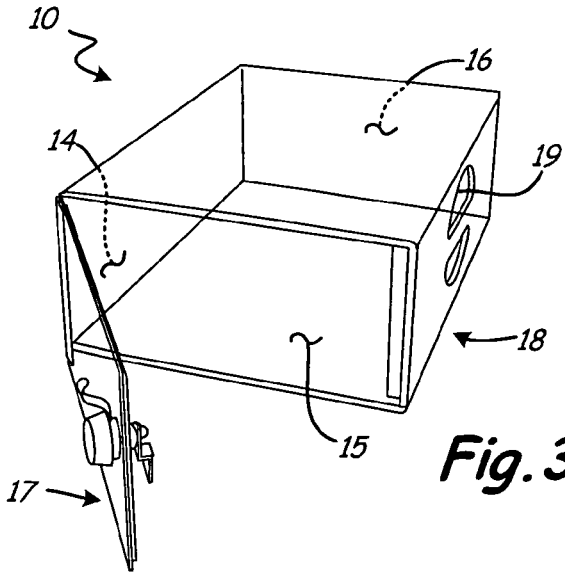
FIG. 3A is a perspective view of a transparent, portable secure container, in an embodiment configured to accommodate a standard twenty-four can retail package.

FIG. 3A is a perspective view of transparent, portable secure container 10, in an embodiment configured to accommodate a standard twenty-four can retail package. In FIG. 3A, container 10 is oriented such that sides 15 lie along a horizontal direction, with bottom 14 to the left and top 18 to the right. In this orientation, door 17 is an end door in end 16, and handle 19 is a top handle with a dual, half-circular geometry in top 18.

In the embodiment of FIG. 3A, the outside dimensions of container 10 are approximately seventeen and a quarter inches (17¼") by twelve inches (12"), by six and one quarter inches (6¼") high (approximately 43.8 cm×30.5 cm×15.9 cm). With these dimensions, container 10 is referred to as a twenty-four can case, and is configured to hold a standard twenty-four can retail beverage container, such as a standard beer case with a capacity of twenty-four cans, each holding twelve ounces of beer.

In embodiments that comprise handle 19, as illustrated in FIG. 3A, the handle or handles are cut into at least one wall panel 11A, or, alternatively, at least one door panel 11B. The handles exhibit various shapes and configurations, including half-circular geometries in both single and double configurations, as shown here and in FIGS. 1, 4A and 4B. Alternatively, handles 19 are oblong, oval, or have another shape, in either single or multiple-opening configurations.

In some methods, handles 19 are cut by routing or milling along a handle template attached to the panel. These methods typically comprise drilling a pilot hole, flush edge routing or milling along the handle outlines, and rounding the outlines with a rounded bit. Typically, handle 19 is rounded along both the inside and outside of container 10.

Figure 3B:
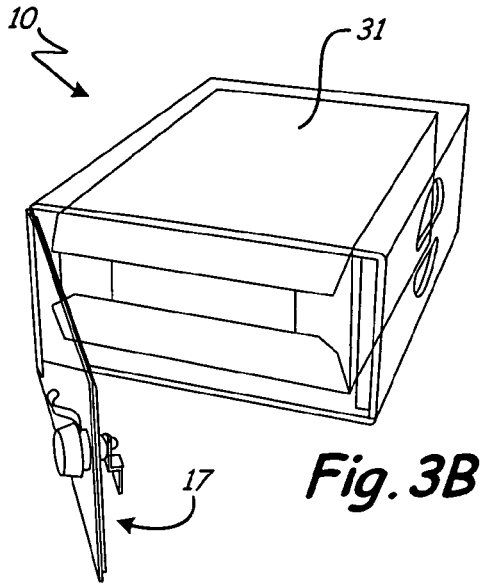
FIG. 3B is a perspective view of the secure container in FIG. 3A, holding the standard retail package with the door in an open position.

FIG. 3B is a perspective view of secure container 10, as embodied in FIG. 3A, holding standard retail beverage package 31 in the form of a twenty-four can case with door 17 in an open position. In this position door 17 provides access to the case, and specifically to the beverage cans inside the case.

Figure 3C:
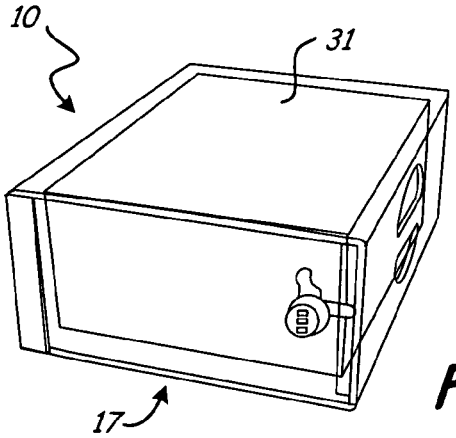
FIG. 3C is a perspective view of the secure container in FIG. 3A, holding the standard retail package with the door in a closed position.

FIG. 3C is a perspective view of secure container 10 as embodied in FIG. 3A, holding standard retail package 31 with door 17 in a closed position. In this position lock 13 secures door 17, restricting access.

FIG. 3C illustrates an important advantage of transparent, portable secure container 10. Because at least one of panels 11A, 11B is formed of a transparent material, container 10 provides an interior view of retail package 31, whether door 17 is in the open or closed position. This contrasts with prior art secure containers, which are typically designed to hide interior contents, rather than to provide an interior view.

This has two effects. First, it retains the display and marketing functions of standard retail package 31. Because secure container 10 is also portable, moreover, and constructed of lightweight materials, it can accommodate standard retail beverage package 31 in a variety of environments, including wholesale, retail, and consumer environments, and room-temperature, refrigerator, or freezer environments.

Moreover, in some embodiments a portion of standard retail beverage package 31 is removable, or otherwise configured to view the number of individual units remaining. This allows transparent secure container 10 to facilitate detection of unauthorized access, even in relatively long-term storage applications during which door 17 is not regularly opened.

Figure 4A:
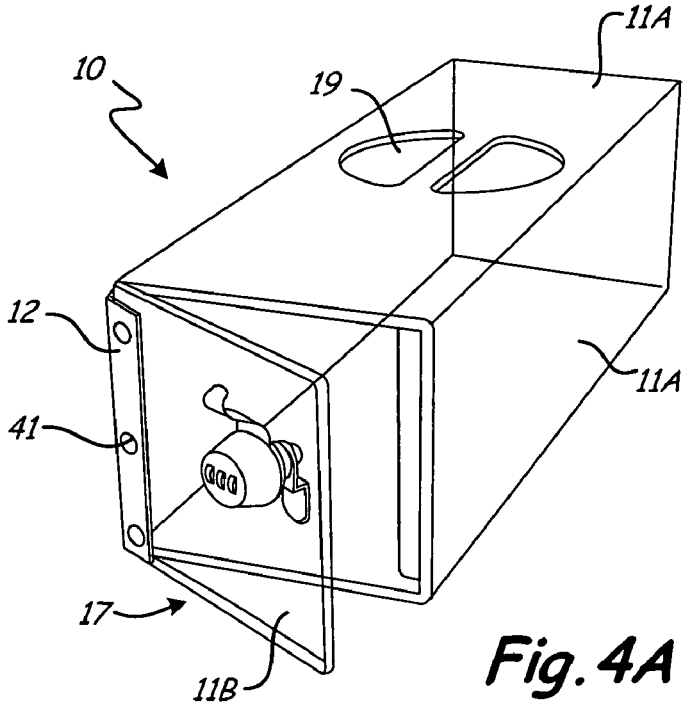
FIG. 4A is a perspective view of a transparent, portable secure container, in an embodiment configured to accommodate a standard twelve can refrigerator package.

FIG. 4A is a perspective view of transparent, portable secure container 10, in an embodiment configured to accommodate a standard twelve-can refrigerator package or low-profile "fridge pack." In this embodiment, the outside dimensions of container 10 are approximately seventeen and a quarter inches (17¼") by six and a quarter inches (6¼"), by six and one half inches (6½") high (approximately 43.8 cm×15.9 cm×16.5 cm). With these dimensions, container 10 is referred to as a twelve-can fridge pack case. FIG. 4A also shows the location of rivets 41 in hinge 12.

Figure 4B:
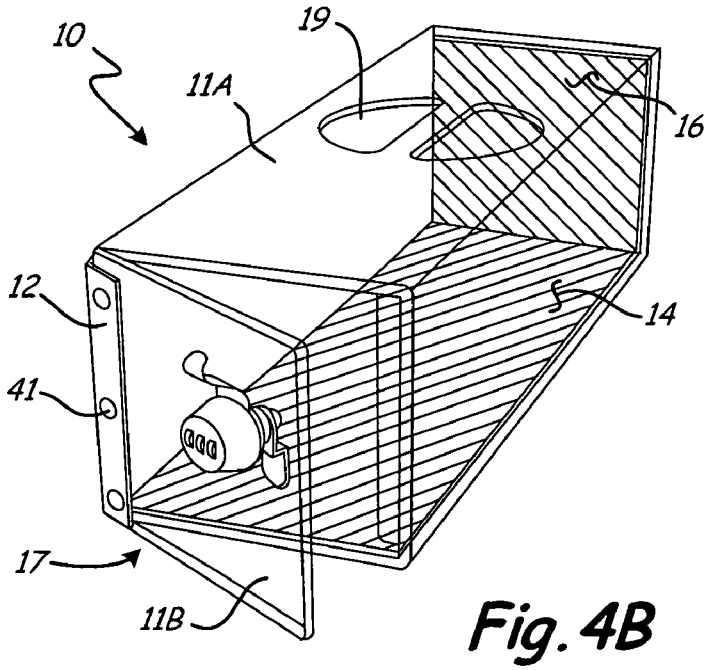
FIG. 4B is a perspective view showing the secure container of FIG. 4A, in an embodiment having a number of opaque panels.

FIG. 4B is a perspective view of secure container 10 as shown in FIG. 4A, in an embodiment having a number of opaque wall panels. In this particular embodiment, wall panels 11A are opaque at bottom 14 and end 16, but in other embodiments the selection of particular opaque and transparent panels varies.

While at least one of panels 11A, 11B is transparent in order to provide a view into container 10 (that is, to make the contents visible), in some embodiments it is desirable for some of panels 11A, 11B to be opaque, as shown in FIG. 4B.

This may be particularly true along bottom 14 and end 16, where there are typically no sight lines, or where sight lines are not desired for aesthetic reasons. This embodiment also increases the range of available construction materials, and in particular encompasses constructions that combine transparent thermoplastics with wood or other lightweight, durable structural materials, including some lightweight, easily formed metals.

Figure 5A:
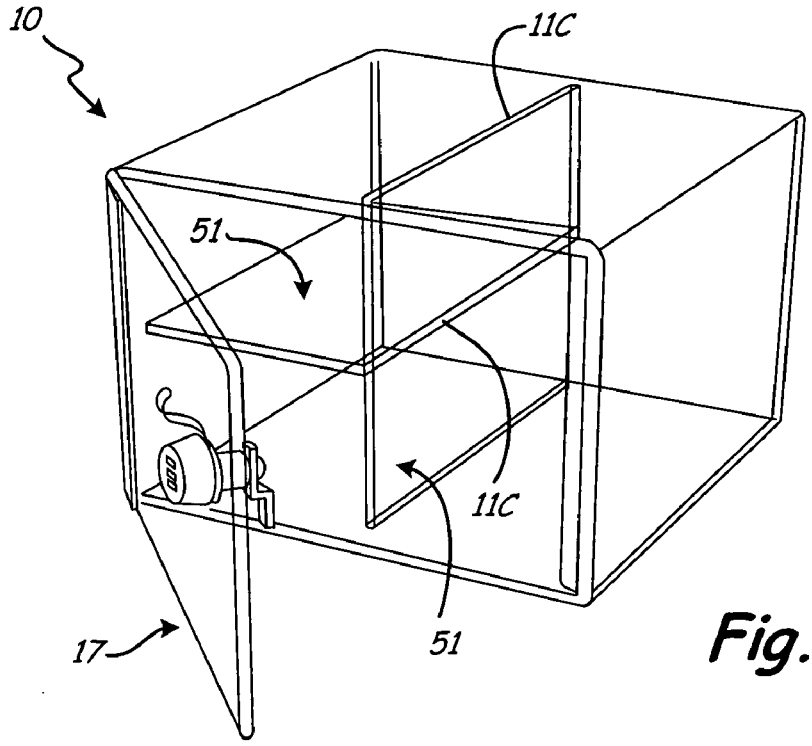
FIG. 5A is a perspective view of a transparent, portable secure container, in an embodiment having an interior divider and an interior shelf.

FIG. 5A is a perspective view of transparent, portable secure container 10, in an embodiment having interior divider 51 and interior shelf 52. Divider 51 and shelf 52 are formed of interior partition panels 11C, as described above with respect to FIG. 2. Divider 51 and shelf 52 allow secure container 10 to accommodate a wide range of standard retail package sizes.

In the particular embodiment of FIG. 5A, container 10 has outside dimensions of approximately ten and one quarter inches (10¼") by ten inches (10"), by eight and three quarter inches (8¾") high (approximately 26.0 cm×25.4 cm×22.2 cm). With these dimensions, container 10 is referred to as a med case, and is configured to hold a number of standard pharmaceutical or medical retail packages, including standard retail containers for over-the-counter medicines or prescription drugs.

In the particular embodiment of FIG. 5A, divider 51 divides secure container 10 vertically into two individual storage areas with a width of 4⅞" (approximately 12.4 cm, accounting for a panel thickness of ¼", or approximately 6 mm). Shelf 52 further divides one of these storage areas into further individual storage areas with a height of 4¼" (approximately 10.8 cm, also accounting for panel thickness).

Figure 5B:
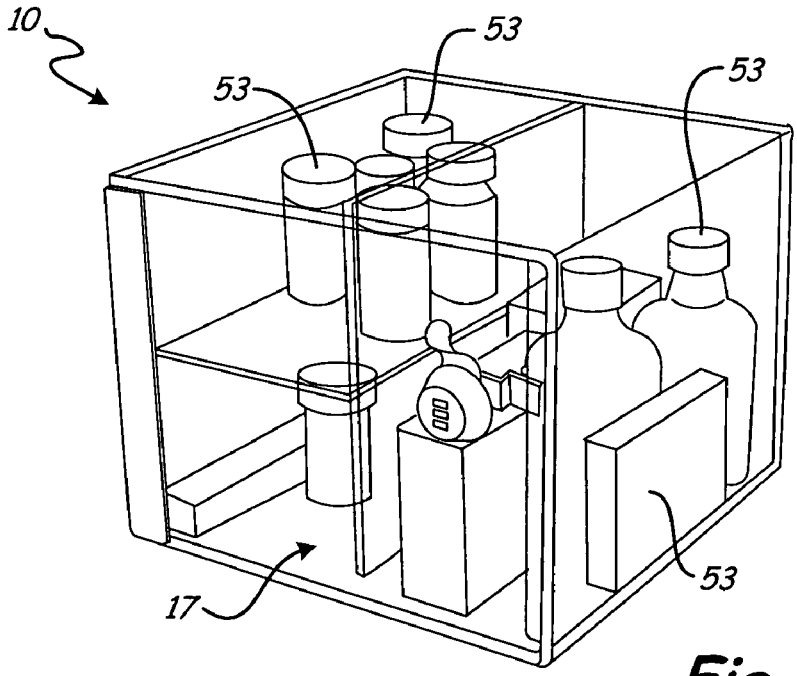
FIG. 5B is a perspective view of the secure container in FIG. 5A, holding a number of standard retail pharmaceutical packages.

FIG. 5B is a perspective view of secure container 10 as embodied in FIG. 5A, holding a number of standard retail pharmaceutical packages 53. In this particular embodiment, the spacing tolerance is adjusted such container 10 holds a number of different retail pharmaceutical packages in each individual storage area.

Together with the various embodiments disclosed above, FIGS. 5A and 5B illustrate that transparent, portable secure container 10 is not restricted to alcoholic beverage packages, but provides a system for restricting access to a range of different consumer products that cannot be purchased by minors, including alcohol and tobacco products, and, in some jurisdictions, particular pharmaceuticals such as pseudoephedrine and certain over-the counter or prescription drugs.

Although the present invention has been described with reference to preferred embodiments, the terminology used is for the purposes of description, not limitation. Workers skilled in the art will recognize that changes may be made in form and detail without departing from the spirit and scope of the invention.

The invention claimed is:

1. A transparent, portable secure container comprising:

a plurality of wall panels joined together to form the container, such that the plurality of wall panels conforms to outside dimensions of a retail package for alcoholic beverages within a spacing tolerance of less than one and one half inches (3.8 cm) to provide a space between the outside dimensions of the retail package and the plurality of wall panels forming the container, with at least one exterior dimension of the container being greater than ten inches (25.4 cm) and no exterior dimension of the container being greater than twenty inches (50.8 cm);

a door panel coupled to the container via a hinge; and a lock for securing the container by locking the door panel in a closed position;

wherein the plurality of wall panels and the door panel are formed of a lightweight, durable structural material, such that the container is portable;

wherein at least one of the wall panels or the door panel is transparent, such that the container provides an interior view when the door is in the closed position; and wherein the retail package has a capacity of at least six individual alcoholic beverage units and is selected from a group consisting of a retail package holding at least twelve single-serving 12-ounce cans and a retail package holding at least twenty-four 12-ounce beer cans.

2. The secure container of claim 1, wherein the retail package holds at least twelve 12-ounce single-serving cans.

3. The secure container of claim 1, wherein the retail package holds at least twenty-four 12-ounce beer cans.

4. The secure container of claim 1, wherein the lightweight, durable structural material comprises a thermoplastic.

5. The secure container of claim 4, wherein the thermoplastic comprises a polycarbonate material.

6. The secure container of claim 5, wherein the hinge is a living hinge comprised of a resilient, flexible, fatigue-resistant polymer.

7. The secure container of claim 1, wherein at least one of the wall panels or the door panel comprises a handle.

8. The secure container of claim 1, wherein at least one of the wall panels or the door panel is opaque.

9. A portable container for restricting access to alcoholic beverages, the portable container comprising:

a plurality of wall panels joined together to form the portable container, such that the portable container holds a retail package for the alcoholic beverages, and the plurality of wall panels conforms to outside dimensions of the retail package within a spacing tolerance of less than one and one half inches (3.8 cm) to provide a space between the outside dimensions of the retail package and the plurality of wall panels forming the portable container;

a door coupled to the portable container via a hinge; and a lock for restricting access to the alcoholic beverages when the door is closed;

wherein the portable container is further transparent, providing a view of the retail package when the door is closed; and wherein the retail package has a capacity of at least six individual alcoholic beverage units and is selected from a group consisting of a beer case with a capacity of twenty-four 16-ounce beer bottles, a refrigerator pack with a capacity of at least twelve 12-ounce beer cans, and a beer case with a capacity of at least twenty-four 12-ounce beer cans.

10. The portable container of claim 9, wherein the retail package is a beer case with a capacity of twenty-four beer 16-ounce bottles.

11. The portable container of claim 9, wherein the retail package is a refrigerator pack with a capacity of at least twelve 12-ounce beer cans.

12. The portable container of claim 9, wherein the retail package is a beer case with a capacity of at least twenty-four 12-ounce beer cans.

13. The portable container of claim 9, wherein the wall panels are formed of a thermoplastic.

14. The secure container of claim 9, wherein the door is transparent.

15. The secure container of claim 9, wherein each of the wall panels is transparent.

16. A system for securing alcoholic beverages, the system comprising:

a retail package holding the alcoholic beverages;

a plurality of wall panels joined to conform to outside dimensions of the retail package within a spacing tolerance of less than one and one half inches (3.8 cm) to provide a space between the outside dimensions of the retail package and the plurality of wall panels forming the container;

a door panel joined to one of the wall panels via a hinge; and a lock configured to secure the door panel in a closed position;

wherein at least one of the wall panels or the door panel is transparent; and wherein the retail package has a capacity of at least six individual alcoholic beverage units and is selected from a group consisting of a case of beer with a capacity of twenty-four 16-ounce beer bottles or at least twenty-four 12-ounce beer cans, and a refrigerator pack of beer with a capacity of at least twelve 12-ounce beer cans.

17. The system of claim 16, further comprising a handle formed in one of the wall panels.

18. The system of claim 16, wherein the plurality of wall panels and the door panel are formed of a transparent thermoplastic.

* * * * *